United States Patent [19]

Sigunick

[11] Patent Number: 4,906,006

[45] Date of Patent: Mar. 6, 1990

[54] PRACTICE GOLF DEVICE

[76] Inventor: Phil Sigunick, P.O. Box 7, Cragsmoor, N.Y. 12420

[21] Appl. No.: 345,431

[22] Filed: Apr. 28, 1989

[51] Int. Cl.[4] ..... A63B 69/36

[52] U.S. Cl. ..... 273/178 R; 273/34 B

[58] Field of Search ..... 273/178 R, 178 A, 178 B, 273/179, 180, 34 B, 127 R, 127 B

[56] References Cited

U.S. PATENT DOCUMENTS

| | | | |
|---|---|---|---|
| D. 77,020 | 11/1928 | Meilicke | D21/234 |
| D. 196,846 | 11/1963 | Niamtu, Jr. | D21/234 |
| 1,558,767 | 10/1925 | Smith | 273/179 C |
| 1,658,740 | 1/1928 | Kurtz | 273/178 R |
| 1,773,813 | 8/1930 | Gourlay et al. | 273/180 |
| 1,846,407 | 2/1932 | Thompson | 273/203 |
| 2,933,318 | 4/1960 | Boynton | 273/178 R |
| 4,171,134 | 10/1979 | Reck | 273/178 R |

*Primary Examiner*—George J. Marlo

*Attorney, Agent, or Firm*—Neuman, Williams, Anderson & Olson

[57] ABSTRACT

A practice golf device used for putting and related strokes is disclosed. The golf device includes a base with an inclined shoulder and a cup opening that defines a target area. A lamina is disposed in the cup opening to dampen the movement of a golf ball entering the cup opening. At least one removable concentric ring member is placed in the cup opening to diminish the size of the cup opening.

9 Claims, 1 Drawing Sheet

PRACTICE GOLF DEVICE

BACKGROUND OF THE INVENTION

The invention relates to a golf device used for practicing putting and related strokes. In particular, the invention relates to a simulated golf cup having removable rings for diminishing the size of the cup.

The skills required for shot making on and around the putting green are quite elusive. The frustration level most golfers experience with this aspect of the game of golf is therefore quite high. Fortunately, the putting stroke may be substantially improved with diligent practice. Thus, many practice putting devices are known in the art.

Typically, putting devices operate by providing a simulated putting green and golf cup, or hole. The simulated putting green may be configured in such a manner to increase or decrease the difficulty of the putting stroke. For example, simulated greens including inclined surfaces or contoured surfaces are well known. Similarly, multiple putting cup configurations arranged in various patterns are well known. Such devices, while they perform satisfactorily under certain circumstances, are somewhat inflexible and bulky, often requiring substantial difficulty in transportation and relocation. The size and complexity of these devices creates a negative impact on the motivation to practice.

Further, such practice golf devices fail to promote concentration on the center of the golf cup during the putting stroke. The traditional approach teaches targeting a point at some distance beyond the cup, usually ten to twelve inches beyond the cup. The average golfer may therefore experience difficulty coordinating the speed of the putt with the center of the golf cup.

Moreover, such devices fail to create a visible awareness of incorrect speed or slightly off-center putts. U.S. Pat. No. 1,555,767 to Smith is an example of such a prior art putting device. In that patent, an inclined putting surface with a putting cup and a return chute in communication with the putting cup are disclosed. Moreover, concentric rings may be placed in the center of the cup to change the effective size of the cup. The purpose of the inclined putting surface and return chute, however, are to return a putted ball to the user. Thus, a slightly off-center putt may travel in a substantially straight path on the inclined plane, and possibly, fall in the putting cup without indication of misalignment. Further, a golf ball struck with an excessive force may nevertheless fall in the putting cup. With use of the Smith device, the average golfer may experience undesired results during a live round of golf.

OBJECTS OF THE INVENTION

Accordingly, a general object of the present invention is to provide an improved practice golf device.

Another object of the present invention is to provide a practice golf device for use as a teaching or learning aid for correction of slightly off-center putts and putts traveling at an improper speed.

A further object of the present invention is to provide a practice golf device that accommodates different levels of skill.

An additional object of the present invention is to provide a practice golf device which promotes an aggressive putting stroke.

Finally, an object of the present invention is to provide a practice golf device that is easily transported.

Other objects and advantages of the present invention will become apparent upon reading the following description and appended claims, and upon reference to the accompanying drawings.

SUMMARY OF THE INVENTION

The above objects are accomplished by providing a practice golf device for receiving a moving golf ball comprising a base, a lamina, and a plurality of concentric ring members. The base comprises a shoulder for decreasing the speed of the golf ball and connects a generally circular outer portion to a generally circular inner portion of the base. The base also has a generally cylindrical cup opening formed inward from the inner portion. The cup opening is the diameter of a regulation putting cup and provides a target area for reception of the golf ball. A lamina for damping the movement and sound of the golf ball is disposed within the cup opening.

One or more concentric ring members are removably fitted within the cup opening. The outer edges of the concentric ring members are either adjacent to the inner edge of the base forming the cup opening or adjacent to each other and diminish the size of the target area.

It is desired that the coloration of the base sharply contrasts the coloration of the lamina and the coloration of the concentric ring members. The contrasting coloration of the device of the present invention provides a readily ascertainable target for the user.

A particular advantage of the present invention is the relationship between the slope of the shoulder and the depth of the cup opening. The inclined shoulder promotes an aggressive and accurate putting stroke. However, the shallowness of the cup opening permits rapidly moving putts to deflect outward of the cup opening. An acute sense of touch is thereby acquired.

Another advantage of the present invention is that the practice golf device is portable and requires little room for storage.

It should be understood that the drawings are not necessarily to scale.

DETAILED DESCRIPTION OF THE PREFERRED EMBODIMENT

Generally, the present invention relates to a practice golf device used as an aid in shot making. The present invention is particularly useful to improve the putting stroke and related shots around the green. The device of this invention encourages aggressive shot making and enables the user to vary the degree of difficulty on successive shots. The invention further detects slight errors in speed or misalignment, allowing the user to provide appropriate compensation on subsequent strokes. Finally, the invention promotes concentration on the center of the device or target area.

Figure 1:
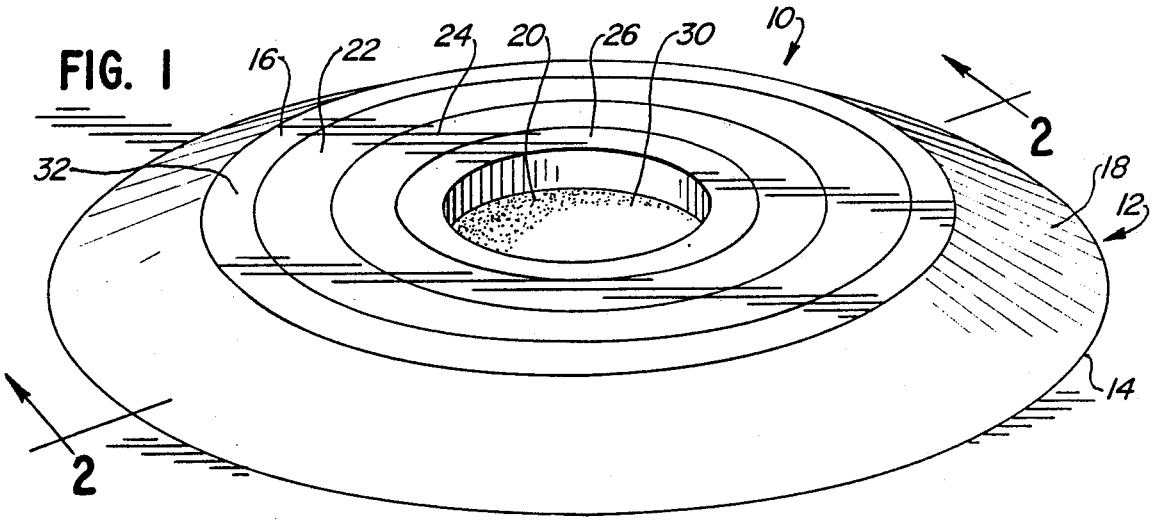
FIG. 1 is a perspective view of a practice golf device incorporating one embodiment of the present invention.

Referring now to FIG. 1, a practice golf device embodying the present invention is generally designated by the numeral 10. Golf device 10 includes a base 12 having a shoulder 18. Shoulder 18 connects a generally circular outer portion 14 and a generally circular inner portion 16. In the illustrated embodiment, base 12 is constructed of wood, preferably finished with a stained dark walnut coloration. The outer portion 14 of base 12 rests on the floor or other suitable surface for practicing golf strokes. For example, golf device 10 may be readily used on a practice putting green.

Figure 2:
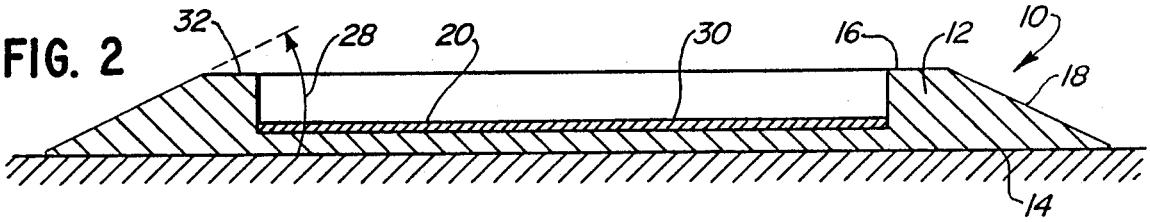
FIG. 2 is a schematic cross sectional view of the base of the practice golf device taken along the line 2—2 of FIG. 1, with the concentric ring members of the practice golf device removed.

Base 12 also has a generally cylindrical cup opening 20 formed therein. Cup opening 20 extends inward from inner portion 16. The diameter of cup opening 20 is 4¼ inches, sized to conform with U.S.G.A. rules. As best shown in FIG. 2, a lamina 30 is inlaid in the portion of base 12 defining cup opening 20. Preferably, lamina 30 comprises a thin layer of carpeting or felt material, substantially decreasing the vibration and movement of a golf ball entering cup opening 20. Lamina 30 also dampens the sound of a golf ball entering cup opening 20. Lamina 30 is preferably colored a bright green, sharply contrasting with the dark walnut coloration of base 12. Lamina 30 may also include a logo in its middle portion (not shown). The color of the logo sharply contrasts the color of lamina 30 to provide focal point in the middle portion of lamina 30. A target is thereby created that is readily perceptible by the user.

It has been found that the angle of inclination 28 of shoulder 18 should be between 22 and 26 degrees, and most preferably 24 degrees, for a golf ball to travel at a sufficient speed to traverse shoulder 18 (FIG. 2). Also, when lamina 30 is laid within cup opening 20, the depth of cup opening 20 is approximately ⅜ inches. A putted golf ball may travel with sufficient speed to overcome shoulder 18 but nevertheless deflect out of cup opening 20 if it is travelling at an excessive speed. The importance of the relationship between the angle of inclination 28 of shoulder 18 and the depth of putting cup 20 becomes apparent. Golf device 10 requires a successful putt to travel at a speed that is sufficient to overcome shoulder 18 but not too great to remain within cup opening 20. The magnitude of error in putts struck with too little force is readily observed when the golf ball rolls up shoulder 18 and falls backward. Likewise, the magnitude of error in putts struck with excessive force is readily observed when the golf ball deflects out of cup opening 20 and continues beyond golf device 10.

Of course, the degree of difficulty of golf device 10 may be substantially increased or decreased by varying the relationship between the angle of inclination 28 of shoulder 18 and the depth of cup opening 20. For increased difficulty, the angle of inclination 28 of shoulder 18 is increased and the depth of cup opening 20 is decreased. A successful putt would therefore encounter a steeper inclination followed by a shallower target area, reducing the margin for error. Conversely, by reducing the angle of inclination 28 of shoulder 18 and increasing the depth of cup opening 20, the margin for error becomes greater.

FIG. 1 also shows a plurality of removable concentric ring members, including ring member 22, ring member 24, and ring member 26. Ring members 22, 24 and 26 are preferably made of bronze or brass, colored in sharp contrast to base 12 and lamina 30. The contrasting coloration of base 12, lamina 30 and ring members 22, 24, and 26 provide a readily ascertainable target, thereby promoting concentration on golf device 10. Ring member 22 is removably fitted, or loosely fitted, within the inner edge of base 12 forming cup opening 20 and rests on lamina 30. When inserted into cup opening 20, the outer edge of ring member 22 is substantially adjacent to the inner edge of base 12 forming circular cup opening 20. Ring member 24 is also removably fitted within cup opening 20, with the outer edge of ring member 24 substantially adjacent to the inner edge of ring member 22. Likewise, ring member 26 is removably fitted within cup opening 20, with the outer edge of ring member 26 substantially adjacent to the inner edge of ring member 24.

A lip 32 is formed in the circular inner portion 16 of base 12 between shoulder 18 and cup opening 20. Lip 32 creates a flat surface that encourages a ball that is struck too softly or slightly off target to wander further from cup opening 20. Preferably, the depth of cup opening 20 is substantially the same as the height of ring members 22, 24 and 26. Thus, the size of lip 32 substantially increases as ring members 22, 24 and 26 are fitted within cup opening 20, further promoting errant shots to travel away from cup opening 20. The user may thereby perceive the misdirected course of an errant shot.

Figure 3:
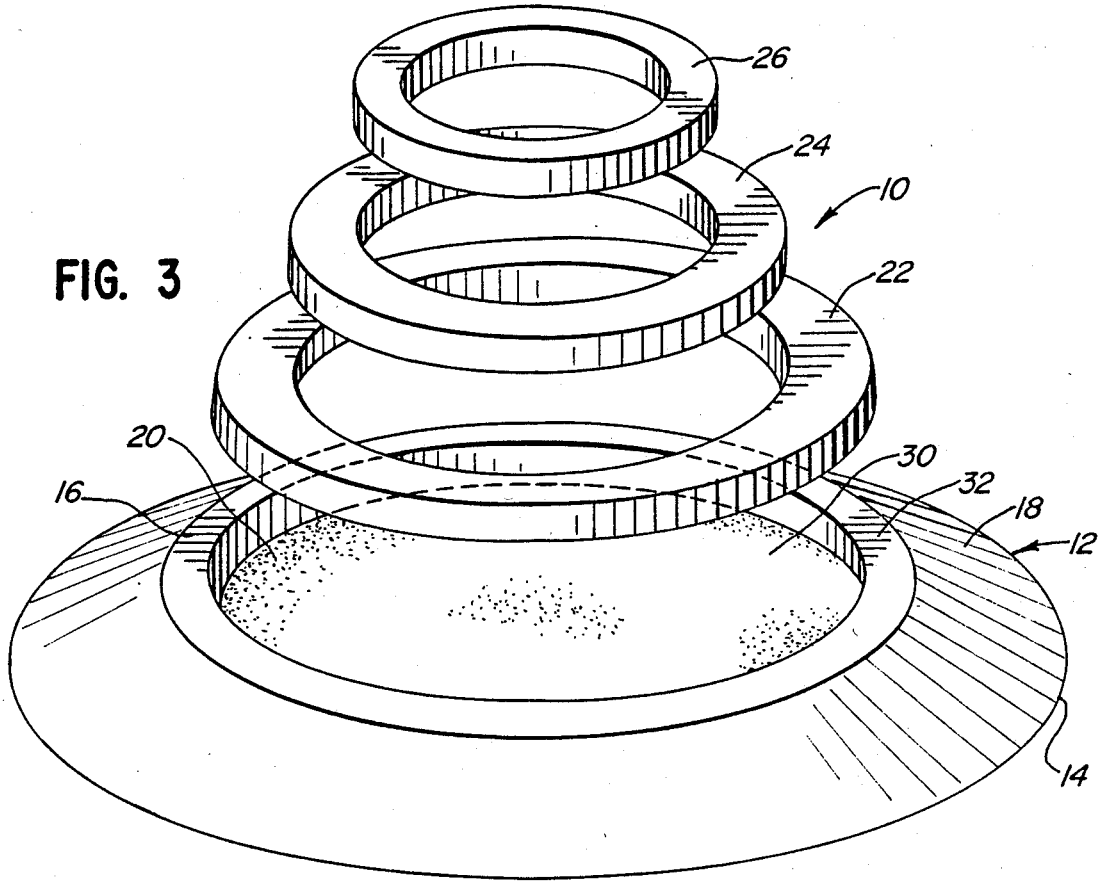
FIG. 3 is an exploded perspective view of the embodiment of FIG. 1, showing the practice golf device in a partially disassembled state.

FIG. 3 illustrates the simple construction associated with the present invention. As shown in FIG. 3, concentric ring members 22, 24 and 26 are readily insertable in the cup opening 20 of base 12. As best seen in FIG. 3, the insertion of ring members 22, 24 and 26 greatly reduces the target area provided by cup opening 20. Also, the easy transportability and minimal space requirements for storage of golf device 10 is readily apparent. However, one could just as easily display golf device 10 on a mantle or table.

In operation, the user selects a desired number of ring members 22, 24 or 26 to insert within cup opening 20. Of course, the user may choose to use golf device 10 without any ring members inserted within cup opening 20. In this state, golf device 10 simulates a regulation size cup. As the user strikes a golf ball and propels the ball toward golf device 10, the golf ball promptly encounters shoulder 18. Shoulder 18 provides a lateral curvature, thereby making specific demands for control of direction of the golf ball. For example, a golf ball which is travelling slightly to the left of cup opening 20 will deflect further away from cup opening 20 when contacting the lateral curvature in shoulder 18. Similarly, a golf ball which is travelling to the right of cup opening 20 encounters the lateral curvature of shoulder 18 on the right side of base 12 and will deflect further to the right.

Further, shoulder 18 makes specific demands on the speed of a stroked golf ball since it must be travelling with sufficient speed to overcome the upward slope of shoulder 18. For example, a golf ball travelling at a slow speed will not overcome the elevation of shoulder 18, and will return toward the user. In this manner, the upward slope of shoulder 18 visibly magnifies weakly struck golf shots. The user may thereby easily assess errors in a putting stroke and correct the putting stroke accordingly.

The elevation provided by shoulder 18 further promotes an aggressive putting stroke since the user must strike the ball with more force than is required to traverse the distance between the user and golf device 10. The user, however, maintains concentration on the target, or the center of cup opening 20. Thus, shoulder 18 fosters an increased muscular response to the perceived distance between the user and the center of golf device 10. The user thereby acquires an aggressive putting stroke while directly focusing on the center of golf device 10, or cup opening 20.

Although shoulder 18 fosters an aggressive stroke, the depth of cup opening 20 prevents a successful putt from travelling at an excessive speed. A putt travelling at such an excessive speed will deflect out of cup opening 20 and continue out of golf device 10, travelling on its original path. The depth of cup opening 20 trains a sureness of touch beyond that required by a deeper regulation putting cup. Of course, the increased sense of touch amply rewards the user during a live round of golf.

For increased difficulty, the depth of cup opening 20 may be reduced with the insertion of one or more removable discs (not shown) which are overlaid on lamina 30. Of course, the diameter of the removable discs must be sized to fit within cup opening 20, or sized to fit within removable ring members 22, 24 and 26 when the ring members are inserted in cup opening 20. Preferably, the removable discs are the same material and thickness as lamina 30 to provide damping of the movement and sound of a golf ball entering cup opening 20. Also, the removable discs have the same coloration as lamina 30, with a logo affixed on their middle portion to provide an ascertainable target.

The target area defined by cup opening 20 substantially decreases with the insertion of ring members 22, 24 and 26. Thus, for example, a more accurate stroke is required when ring member 22 is fitted within bore 20. Similarly, the target area decreases when ring members 24 and 26 are fitted within bore 20. With all three ring members 22, 24 and 26 in place, the target area within bore 20 is just large enough to permit entry of a golf ball. Players of different skill levels may accordingly adjust the area of cup opening 20 according to the skill level desired. With all three ring members in place, the user directly focuses on the center of bore 20. While the preferred embodiment envisions three concentric ring members, one could just as easily use any number of ring members.

Of course, any number of golf shots may be used with golf device 10. For example, golf device 10 is useful to aid chipping techniques and other similar shots. Because of the circular configuration of golf device 10, any number of users may be positioned relative to golf device 10 at the same time.

While the invention is primarily used as a teaching aid for practice purposes, it could just as easily be used for tournament or other forms of competition. For example, any number of users could record the number of successful putts at varying distances from golf device 10 and with any number of ring members in place. Of course, the invention could be used for recreational purposes as well. Therefore, a practice golf device that is an improvement over prior art devices has been shown and described.

While a particular embodiment of the invention has been shown and described, it will be understood, of course, that the invention is not limited thereto, since modifications may be made and other embodiments of the principles of this invention will occur to those skilled in the art to which this invention pertains, particularly upon considering the foregoing teachings.

What is claimed is:

1. A practice golf device for receiving a moving ball comprising:

a base having a shoulder for decreasing the speed of said ball, said shoulder connecting a generally circular outer portion and a generally circular inner portion of said base, said base having a generally cylindrical cup opening formed inward from said inner portion, said cup opening defining a target area for ball reception;

a lamina disposed in said cup opening for damping the movement of said ball entering said cup opening; and at least one removable concentric ring member, said ring member removably fitted within said cup opening having its outer edge closely adjacent to the inner edge of said base forming said cup opening for diminishing the size of said target area.

2. The practice golf device of claim 1, wherein said cup opening is substantially the same diameter as a regulation putting cup.

3. The practice golf device of claim 1, wherein there are three removable concentric interfitting ring members.

4. The practice golf device of claim 1, wherein the angle of inclination of said shoulder is between 22 and 26 degrees.

5. The practice golf device of claim 1, wherein the depth of said cup opening between said inner portion and said lamina is approximately $\frac{3}{8}$ inches.

6. The practice golf device of claim 5, wherein the height of said ring member is substantially the same as the depth of said cup opening for increasing the size of said inner portion.

7. The practice golf device of claim 1, wherein the color of said lamina sharply contrasts the color of said concentric ring members to promote perception of said target area.

8. The practice golf device of claim 1, wherein a logo is affixed on said lamina to promote perception of said target area.

9. The practice golf device of claim 1, further comprising at least one removable disc overlaid on said lamina for reducing the depth of said cup opening, said removable disc sized to fit within said cup opening or within said ring member.

* * * * *